US006058693A

United States Patent [19]

Stahlecker et al.

[11] Patent Number: 6,058,693

[45] Date of Patent: May 9, 2000

[54] SPINNING PROCESS AND APPARATUS FOR PERFORMING SAME

[76] Inventors: Fritz Stahlecker, Josef-Neidhart-Strasse 18, 73337 Bad Überkingen, Germany; Hans Stahlecker, Haldenstrasse 20, 73079 Suessen, Germany

[21] Appl. No.: 09/172,253

[22] Filed: Oct. 14, 1998

[30] Foreign Application Priority Data

Oct. 22, 1997 [DE] Germany ..... 197 46 602

[51] Int. Cl.[7] ..... D01H 4/00

[52] U.S. Cl. ..... 57/400; 57/333; 57/401; 57/403

[58] Field of Search ..... 57/400, 401, 403, 57/333, 350

[56] References Cited

U.S. PATENT DOCUMENTS

| | | | |
|---|---|---|---|
| 4,676,062 | 6/1987 | Brockmanns et al. | 57/403 |
| 4,724,668 | 2/1988 | Wassenhoven | 57/333 |
| 5,159,806 | 11/1992 | Mori et al. | 57/328 |
| 5,187,930 | 2/1993 | Stahlecker | 57/400 |
| 5,222,352 | 6/1993 | Stahlecker | 57/333 |
| 5,263,310 | 11/1993 | Mori | 57/333 |
| 5,528,895 | 6/1996 | Deno | 57/350 |
| 5,647,197 | 7/1997 | Imamura | 57/350 |
| 5,768,878 | 6/1998 | Stahlecker | 57/403 |
| 5,768,879 | 6/1998 | Stahlecker | 57/403 |
| 5,775,086 | 7/1998 | Stahlecker | 57/408 |
| 5,778,653 | 7/1998 | Stahlecker | 57/403 |
| 5,890,356 | 4/1999 | Stahlecker | 57/403 |
| 5,899,056 | 5/1999 | Stahlecker et al. | 57/400 |

FOREIGN PATENT DOCUMENTS

4040102A1 6/1992 Germany .

*Primary Examiner*—William Stryjewski
*Attorney, Agent, or Firm*—Evenson, McKeown, Edwards & Lenahan, P.L.L.C.

[57] ABSTRACT

A spinning process provides for opening at least one sliver to single fibers and for depositing the single fibers on a moving collecting surface in the form of an expanded fiber veil. During transport on the collecting surface and, if required on a moving drafting surface downstream thereof, the fiber veil is condensed, transversely to its direction of motion, to a strand. The roving-like strand is transported through a nipping line and twisted to a yarn under the action of a rotating air stream. Fiber ends are hereby spread out from the strand, which are helically wrapped around the yarn.

42 Claims, 3 Drawing Sheets

SPINNING PROCESS AND APPARATUS FOR PERFORMING SAME

BACKGROUND AND SUMMARY OF THE INVENTION

This application claims the priority of German application 197 46 602.8, filed in Germany on Oct. 22, 1997, the disclosure of which is expressly incorporated by reference herein.

The present invention relates to a spinning process in which at least one sliver is opened to single fibers which are deposited on a moving collecting surface and are compressed transversely to their motion of direction to form a strand, the strand being transported through a nipping line and twisted to a yarn downstream of the nipping line under the action of a rotating air stream.

In U.S. Pat. No. 4,676,062 a process of this type is disclosed. A rapidly rotating opening roller opens a sliver to single fibers, which are carried in the form of a so-called fiber swarm by an air current and deposited on a collecting surface of a rotating sieve drum. The air current which transports the fiber swarm to the collecting surface is increasingly confined laterally by means of channel walls, so that the single fibers are deposited on the collecting surface, which has only a narrow suction slit, as an already condensed strand. This strand is transported through a nipping line, which the sieve drum forms together with a nipping roller. A further s-sieve drum may be arranged downstream of the sieve drum before reaching the nipping line, which second sieve drum takes up the condensed strand and which sieve drum can be driven with a higher or a lower speed. Downstream of the nipping line is a twist nozzle (not described in detail), which imparts a false twist to the strand. After the false twist has disentangled again, spread out single fibers are wrapped around the strand and thus form a yarn, whose interior fibers are essentially free of any twist.

The advantage of the known spinning process is to be seen in that during the execution of the known pneumatic false twist spinning, the usually present drafting arrangement is replaced by an opening roller, whereby after the single fibers have been opened from the sliver before reaching the twist nozzle, a strand is formed which is not unlike the sliver coming from a drafting arrangement. What is a disadvantage, however, is that the parallel alignment of the fibers originally present in the sliver is lost when the opened single fibers are transported in an air current, so that the fiber swarm arriving at the collecting surface does not consist any more of orderly deposited fibers. It is further a disadvantage that the formed yarn is twisted only in its outer area by means of wrapping fibers, while the core of the yarn, as is usual in pneumatic false twist spinning, is to a great extent twist-free.

From U.S. Pat. No. 5,775,086 it is known that single fibers, from one or more slivers, opened by means of an opening roller and in the form of a fiber veil, are deposited on a moving collecting surface arranged downstream, which is here also in the form of a sieve drum. The periphery of the opening roller is perforated and suctioned, so that the end of the sliver, the so-called fiber beard, is intensively combed. The collecting surface is in close proximity to the fiber beard and takes up the single fibers before their speed becomes too high. This action is supported by the perforation of the opening roller, which in this embodiment can run relatively slowly. As the teeth of the opening roller have a negative front angle, the transfer of fibers from the opening roller to the collecting surface takes place very quickly. A fiber veil arises, in which the single fibers are arranged parallel to one another and aligned in their direction of motion. The disadvantage to this embodiment is the yarn withdrawal, which runs transverse to the direction of motion of the collecting surface, so that the single fibers arriving at the spinning line are false twisted before a real twist is imparted by a twist device arranged downstream. The formed yarn in this arrangement is thus not sufficiently tear-resistant.

It is known from German published patent application 40 40 102 that single fibers are deposited on a collecting surface in the form of a rotating disc, and are condensed more and more to a strand by pneumatic means, namely a suction slit which tapers in transport direction. The condensed strand is guided to a twist nozzle which, as in the prior art mentioned above, creates a yarn whose fibers located at the yarn core are, to a great extent, twist-free. Due to the omission of a nipping line directly before the twist nozzle, that point which acts as a twist block is not well defined.

A further developed twist nozzle is known from U.S. Pat. No. 5,159,806, which not only false-twists a thread fed from a drafting arrangement, as is usual in pneumatic false twist spinning, but rather furthermore ensures by special means the spreading of fiber ends, which wrap themselves helically around the forming yarn. The twist nozzle comprises in its interior a needle-like guiding element aligned in the direction of motion of the fiber strand, which guiding element is disposed inside the fiber strand and directed towards an entry opening of a yarn withdrawal tube. Thus the fiber strand is spread to such an extent that the fiber ends are spread in sufficient number and sufficient length, so that the forming yarn has an open-end like character. The drafting arrangement arranged upstream is very susceptible and requires much maintenance due to the required high drafting, so that in this process the withdrawal speeds actually possible cannot be utilized to their full extent.

It is an object of the present invention to improve the above named spinning process in that the advantages of the additional described prior art can be used without having to take into account the accompanying disadvantages. In particular, a spinning process is to be devised whereby an open-end like yarn is generated by means of a twist nozzle and using an opening roller, whereby, during the entire spinning process, the originally present parallelism of the single fibers in the sliver is not lost.

This object has been achieved in accordance with the present invention in that

- the single fibers, after they have been opened from the sliver, are disposed on the collecting surface in the form of an expanded fiber veil,
- the fiber veil is subsequently condensed to the strand and
- under the action of a rotating air stream, fiber ends are spread out of the strand.

The fiber veil taken up by the collecting surface consists then of single fibers extending parallel and in the direction of motion, when the transfer does not take place in an air stream inside a fiber channel, but rather when, for example, the collecting surface is located relatively near to an opening roller. The number of single fibers in the fiber veil may already correspond to the number of fibers located in the cross section of the yarn. Due to the condensing of the fiber veil transversely to its direction of motion on the collecting surface, the parallel alignment of the fibers is maintained, and a strand arises, corresponding to a large extent to the proportions of a standard drafting arrangement. A nipping roller, which defines the spinning line, is also a contributory factor. The twist nozzle arranged downstream of the nipping line can in principle correspond to one which, for example, spreads out fiber ends from a strand in sufficient amounts and length by means of a needle-like guidance.

It can be favorable when the strand is stretched in the direction of motion during condensing. This can take place, for example, in that a drafting roller rotating slightly faster is arranged downstream of a transport roller comprising the collecting surface, which drafting roller takes over the already slightly condensed fiber veil and condenses it completely to a strand. The single fibers are hereby accelerated somewhat and improved further in their alignment.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
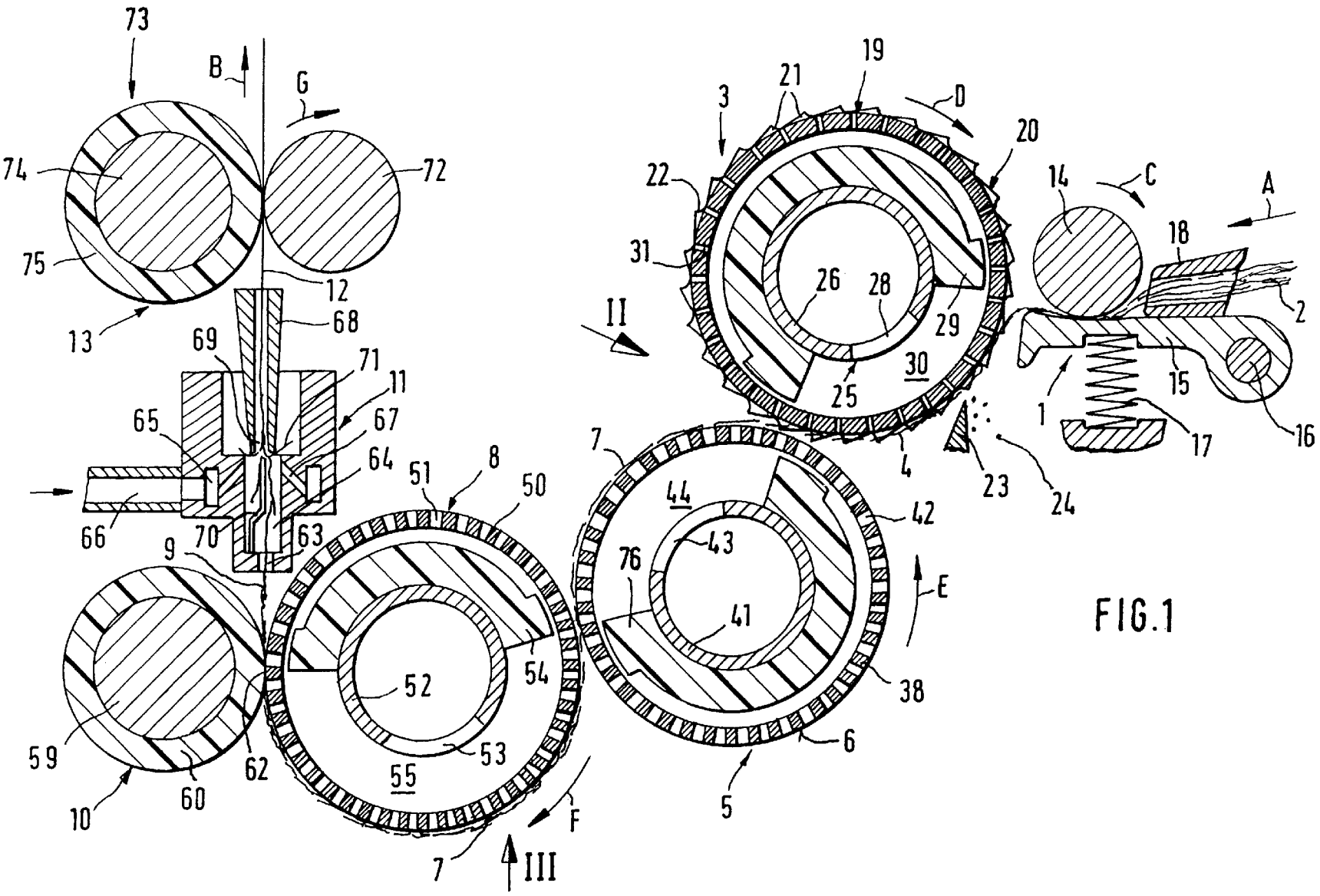
FIG. 1 is a cross section of an arrangement for carrying out the spinning process of the present invention.
Figure 2:
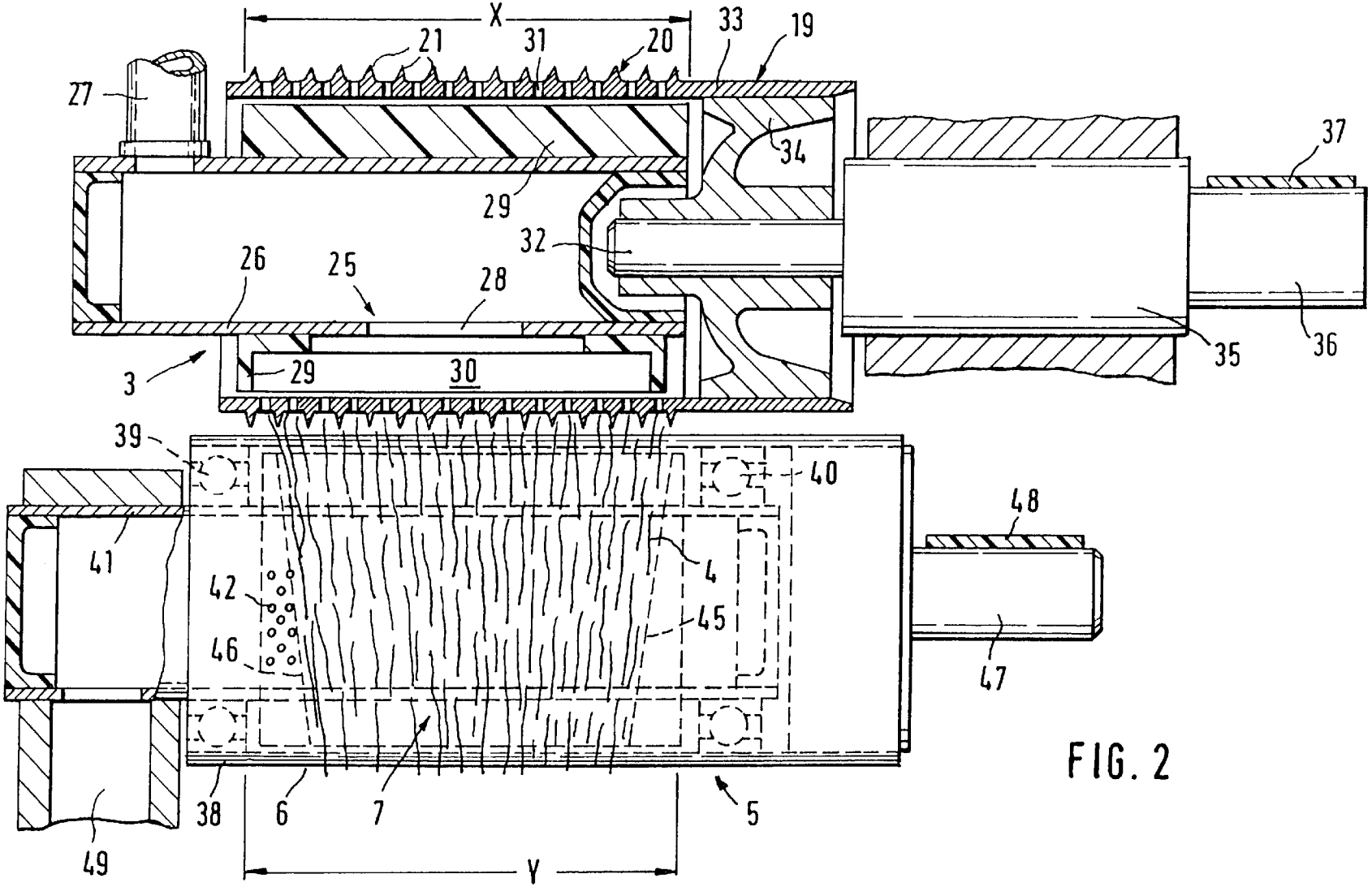
FIG. 2 is a partly sectional view taken in the direction of the arrow II of FIG. 1.

The arrangement for carrying out the spinning process comprises a feeding device 1, to which at least one sliver 2 is fed in feed direction A. An opening device 3 is arranged downstream of the feeding device 1, which opening device 3 opens the at least one sliver 2 into single fibers 4. The single fibers 4 are subsequently taken up in the form of a fiber veil 7 by a collecting surface 6 of a transport roller 5. A drafting roller 8 is arranged downstream of the transport roller 5, which drafting roller 8 can be used, but need not necessarily be present. The fiber veil 7 is condensed laterally to a strand 9 mostly on the drafting roller 8, but to some extent also beforehand on the transport roller 5.

The strand 9 is pressed lightly on the drafting roller 8 by means of a nipping roller 10. A twist nozzle 11 is arranged directly downstream thereof, in which the twist of the yarn 12 to be spun is generated. The yarn 12 is withdrawn by means of a withdrawal roller pair 13 in withdrawal direction B.

The feeding device 1 comprises a feed roller 14, which is driven in rotational direction C. A feed table 15 is arranged at the feed roller 14, which feed table 15 can be swivelled around a swivel axle 16 and pressed against the feed roller 14 by a loading spring 17. A sliver funnel 18 is arranged upstream of the feed roller 14, which sliver funnel 18 has advantageously a plurality of feed channels when a plurality of slivers 2 are fed thereto.

The opening device 3 comprises an opening roller 19, which is driven in the same direction as the feed roller 14, that is, in rotational direction D. The periphery of the opening roller 19 has a toothed ring 20, whose teeth 21 are provided with fronts 22 preferably having a negative angle as schematically shown.

Approximately at that point where the single fibers 4 are opened from the sliver 2, a separating edge 23 is located, at which trash particles 24 present in the sliver 2 are removed.

The opening roller 19 has an effective width X, which corresponds to the width of the fed sliver 2 or slivers 2.

In the inside of the opening roller 19, a suction device 25 is located, which comprises a suction tube 26 connected to a vacuum source 27. The suction tube 26 comprises a suction opening 28, whose suction area 30 is defined by a sealing insert 29. By means of a perforation 31 present on the periphery of the opening roller 19, a suction is generated against the sliver 2 to be opened, which suction pulls the sliver 2 deep into the toothed ring 20, even when the opening roller 19 is driven at a relatively low speed. The suction area 30 extends approximately over an angle of 45° to 90°, that is, as far as the single fibers 4 are to be transported on the periphery of the opening roller 19.

The toothed ring 20 is a component of a combing ring 33, which is affixed to a base body 34, which in turn is connected to a shaft 32. The shaft 32 is supported in a stationarily supported bearing housing 35, and provided with a drive wharve 36 on the end of the bearing housing 35 facing away from the combing ring 33, on which drive wharve 36 a drive belt is disposed.

It is, of course, self-evident that the suction pipe 26 must be aligned in such a way towards the bearing housing 35 so that the sealing insert 29 can exactly define the suction area 30.

The transport roller 5 comprises a tube 38 on its periphery, which is driven in rotational direction E. The tube 38 is supported with bearings 39 and 40 on a stationary suction tube 41. The effective width Y corresponds to the width of the fiber veil 7. The tube 38 is provided on its periphery with a perforation 42, which permits a suction effective from the outside inwards.

The suction tube 41 is provided with a suction opening 43, at which is again arranged a sealing insert 53, which defines a suction area 44. The suction area 44 begins approximately there where the suction area 30 of the opening roller 19 ends. The suction area 44 has lateral contours 45 and 46, which are shown in FIG. 3 by means of dot-dash lines, from which it can be seen that the suction area 44 diminishes in transport direction.

The transport roller 5 has a drive shaft 47, which is driven by a drive belt 48. The suction tube 41 is connected to a vacuum source (not shown) by means of a vacuum conduit 49.

The drafting roller 8 arranged downstream of the transport roller 5 is driven in rotational direction F, that is, in the opposite direction to the transport roller 5. The drafting roller 8 comprises a tube 50, which is provided with a perforation 51 on its periphery. The tube 50 is supported on a suction tube 52 in a way not shown, but similar to the tube 38 of the transport roller 5. The suction tube 52 comprises a suction opening 53, whereby again a suction area 55 is defined by means of a sealing insert 54. The suction area 55 begins approximately there where the suction area 44 of the transport roller 5 ends, and reaches almost to the nipping roller 10.

Figure 3:
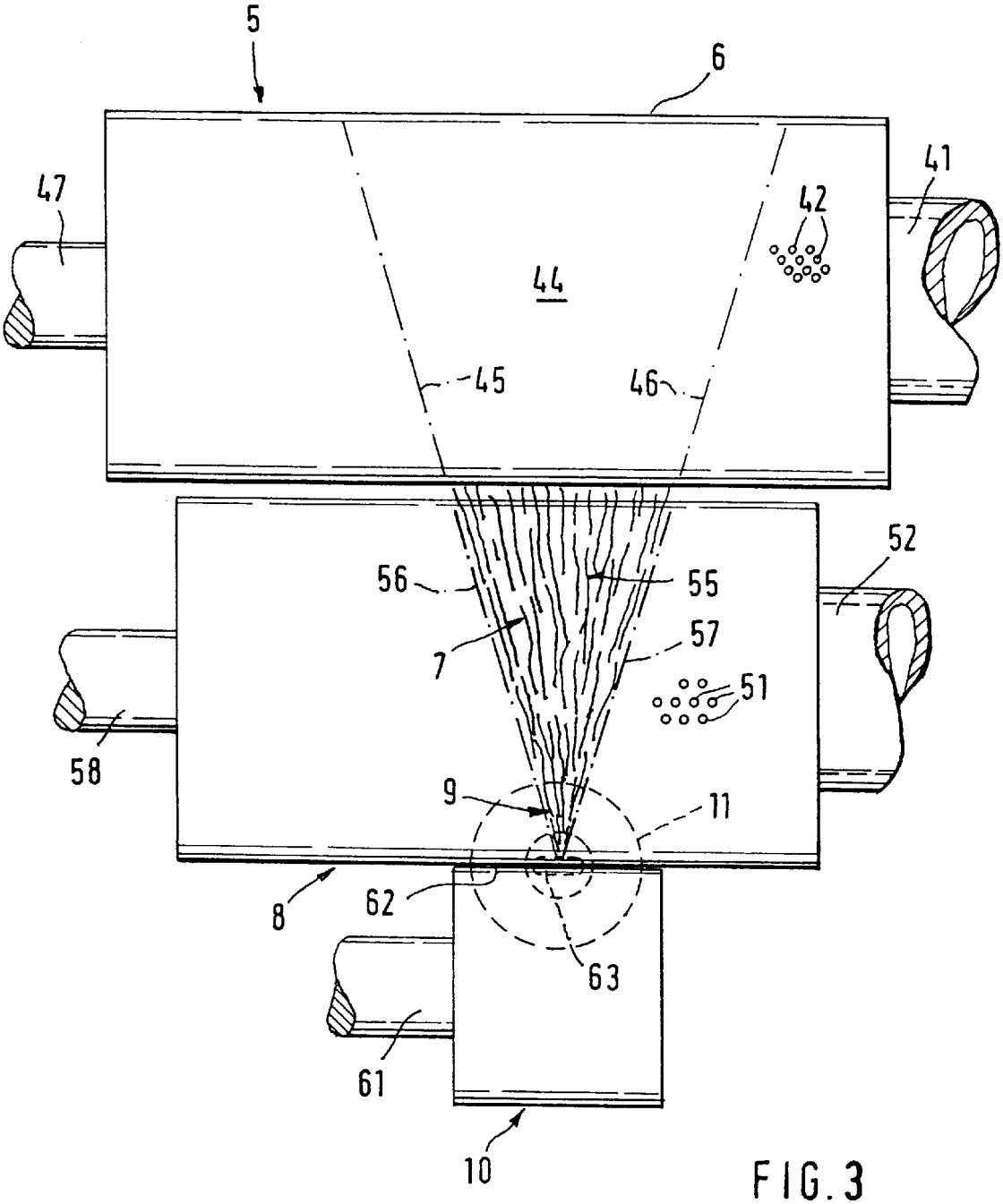
FIG. 3 is a schematic view in the direction of the arrow III of FIG. 1.

As can be seen by means of dot-dash lines in FIG. 3, the contours 56 and 57 of the suction area 55 are arranged in such a way that they diminish in transport direction.

The drafting roller 8 is provided with a drive shaft 58, which is driven by a drive belt (not shown).

The contours 45 and 46 of the suction area 44 of the transport roller 5 and the contours 56 and 57 of the suction area 55 of the drafting roller 8 diminish in the described way in transport direction and thus form means for pneumatic condensing of the single-fibers 4 to a strand 9 transversely to their direction of motion.

The nipping roller 10 comprises a base body 59, which is provided on its periphery with a flexible covering 60. An axle 61 of the base body 59 is supported so that it can be swivelled, in a way not shown, so that the nipping roller 10 can be pressed with a light pressure on the drafting roller 8.

The nipping roller 10, which is arranged parallel to the axis of the drafting roller 8, defines together with the drafting roller 8 a nipping line 62 for the condensed strand 9. The suction areas 44 and 55 have condensed the initially widened fiber veil 7 transversely to its direction of motion to a strand 9, as would correspond to the proportions of a standard drafting arrangement, so that the strand 9 can in this form enter a twist nozzle 11.

The twist nozzle 11 has an entry opening 63, at which a longitudinal channel 64 begins. The strand 9 enters this longitudinal channel 64 and is twisted therein to a yarn 12.

The twist nozzle 11 is similarly designed to the one disclosed in U.S. Pat. No. 5,159,806. It comprises a ring channel 65, which is under excess pressure, see also the pneumatic conduit 66 with the arrow. At the ring channel 65, a plurality of pneumatic jets 67 begin, which are inclined in the travel direction of the yarn 12 and which go into the longitudinal channel 64, namely in the proximity of an entry opening 69 of a yarn withdrawal tube 68 arranged in the longitudinal channel 64.

A needle-like guidance 70 is arranged at the strand 9, as disclosed in the above mentioned U.S. Pat. No. 5,159,806. This guidance 70 is aligned in the direction of motion of the strand 9 and lies inside the strand 9, namely aligned against the entry opening 69, in whose area it ends. With the aid of the rotating air stream coming out of the jets 67, the guidance 70 serves the purpose of spreading fiber ends 71 in a sufficient number and length from the strand 9. The spreading out process is described in detail in the above mentioned U.S. Pat. No. 5,159,806. When the strand 9 enters the yarn withdrawal tube 68 through the entry opening 69, the spread-out fiber ends 71 are capable of being disposed, helix like, around the arising yarn 12, so that the yarn 12 has, to a great extent, a real twist in the manner of an open-end yarn after it has left the yarn withdrawal tube 68.

The withdrawal roller pair 13 arranged downstream of the twist nozzle 11 comprise a driving cylinder 72 driven in rotational direction G, against which a pressure roller 73 is flexibly pressed. The pressure roller 73 comprises a base body 74, which is provided on its periphery with a flexible covering 75. The pressure roller 73 is supported in a way which permits swivelling (not shown).

A winding device (not shown) is arranged downstream of the withdrawal pair 13, where the spun yarn 12 is wound onto a package.

The geometric arrangement of the device is such that the collecting surface 6 of the transport roller 5 is so closely adjacent to the periphery of the opening roller 19 that the single fibers 4 at the end of the suction area 30 can be transferred to the collecting surface 6 in the form of a fiber veil 7 without difficulty. The peripheral speed of the transport roller 5 is somewhat higher than the speed of the arriving single fibers 4.

The drafting roller 8, present only if desired, is also closely adjacent to the transport roller 5, so that the fiber veil 7 can be transferred without difficulty to the periphery of the drafting roller 8. The circumferential speed of the drafting roller 8 is slightly higher than the circumferential speed of the transport roller 5.

The effective width X of the opening roller 19 as well as the effective width Y of the collecting surface 6 are selected so that either a very wide sliver 2 is fed, or a plurality of normal-sized slivers 2 are fed adjacent to one another. The fiber veil 7 preferably comprises in its width that number of single fibers 4 which correspond approximately to the number of fibers present in the cross section of the yarn 12.

The transport roller 5 and the drafting roller 8 should have a sufficiently large diameter so that the tapering of the suction areas 44 and 55 does not occur too spontaneously.

The nipping roller 10 as well as the pressure roller 73 should have as large a diameter as possible because of expected wear. The nipping roller 10 does not need to be pressed hard against the drafting roller 8, as the nipping roller 10 has no drafting function, as opposed to the delivery roller of a standard drafting arrangement. The nipping roller 10 controls only the condensed strand 9, which subsequently enters the twist nozzle 11.

Due to the perforation 31, the circumferential speed of the opening roller 19 can be lower than those opening rollers used in open-end rotor spinning. As the end of the sliver 2, the scalded fiber beard, is drawn deeply into the toothed ring 20, an intensive combing takes place. Due to the preferably negative front angle of the teeth 21, the single fibers 4 at the end of the suction area 30 are transferred very quickly to the collecting surface 6, as a negative front angle tends to deliver the transported single fibers 4 outwards.

The circumferential speed of the transport roller 5 is, as already mentioned, somewhat higher than the circumferential speed of the opening roller 19. The circumferential speed of the drafting roller 8 is in turn somewhat higher than the circumferential speed of the transport roller 5. Ultimately, the circumferential speed of the withdrawal roller pair 13 is somewhat higher than the circumferential speed of the drafting roller 8 and the nipping roller 10. This means that the fibers are continuously accelerated somewhat during the entire spinning process, which has a positive effect on their parallel alignment.

As the greatest part of the pneumatic condensing of the fiber veil 7 to a strand 9 takes place on the periphery of the drafting roller 8, it is favorable when the strand 9 is stretched somewhat in the direction of motion. The speed of the drafting roller 8 is thus chosen accordingly, based on tests.

The fiber veil 7 disposed on the collecting surface 6 is at first rather wide, but is already narrowed somewhat on the transport roller 5 due to the diminishing suction area 44, and transferred to the drafting roller 8 in this form. The strand 9 is condensed to such a degree at the nipping roller 10 that it can enter the twist nozzle 11 without any difficulties. Due to the omission of the standard drafting arrangement, there are no problems whatsoever when the strand 9 enters the twist nozzle 11, in particular no difficulties with regard to the spinning speed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A spinning process comprising:

opening at least one sliver to single fibers, disposing the single fibers on a moving collecting surface in the form of a fiber veil after they have been opened from the sliver, subsequently condensing the fiber veil transversely to its direction of motion to form an untwisted strand, transporting the strand through a nipping line, and twisting the strand to form a yarn downstream of the nipping line with the action of a rotating air stream, wherein fiber ends are spread out of the strand under the action of the rotating air stream, and wherein the fibers are guided during the twisting utilizing a needle-like guidance provided in the inside of the twist nozzle, aligned in the direction of motion of the strand, which guidance is disposed inside the strand and directed against an entry opening of a yarn withdrawal tube.

2. A spinning process according to claim 1, wherein the fiber veil is drafted in the direction of motion during condensing.

3. A spinning process according to claim 2, wherein the speed of the collecting surface corresponds approximately to the current speed of the single fibers when they reach the collecting surface.

4. A spinning process according to claim 3, wherein the fiber veil is condensed by means of pneumatic forces.

5. A spinning process according to claim 4, wherein the spread out fiber ends are wrapped helically around the strand and thus form the yarn with to a large extent a real twist.

6. A spinning process according to claim 2, wherein the fiber veil is condensed by means of pneumatic forces.

7. A spinning process according to claim 2, wherein the spread out fiber ends are wrapped helically around the strand and thus form the yarn with to a large extent a real twist.

8. A spinning process according to claim 2, wherein the number of single fibers per unit length located in the fiber veil corresponds to the number of fibers per unit length present in the cross section of the yarn.

9. A spinning process according to claim 1, wherein the speed of the collecting surface corresponds approximately to the current speed of the single fibers when they reach the collecting surface.

10. A spinning process according to claim 9, wherein the fiber veil is condensed by means of pneumatic forces.

11. A spinning process according to claim 9, wherein the spread out fiber ends are wrapped helically around the strand and thus form the yarn with to a large extent a real twist.

12. A spinning process according to claim 9, wherein the number of single fibers per unit length located in the fiber veil corresponds to the number of fibers per unit length present in the cross section of the yarn.

13. A spinning process according to claim 1, wherein the fiber veil is condensed by means of pneumatic forces.

14. A spinning process according to claim 13, wherein the spread out fiber ends are wrapped helically around the strand and thus form the yarn with to a large extent a real twist.

15. A spinning process according to claim 13, wherein the number of single fibers per unit length located in the fiber veil corresponds to the number of fibers per unit length present in the cross section of the yarn.

16. A spinning process according to claim 1, wherein the spread out fiber ends are wrapped helically around the strand and thus form the yarn with to a large extent a real twist.

17. A spinning process according to claim 16, wherein the number of single fibers per unit length located in the fiber veil corresponds to the number of fibers per unit length present in the cross section of the yarn.

18. A spinning process according to claim 1, wherein the number of single fibers per unit length located in the fiber veil corresponds to the number of fibers per unit length present in the cross section of the yarn.

19. A spinning process according to claim 18, wherein the number of single fibers per unit length located in the fiber veil corresponds to the number of fibers per unit length present in the cross section of the yarn.

20. An arrangement for carrying out a spinning process comprising:

opening at least one sliver to single fibers, disposing the single fibers on a moving collecting surface in the form of a fiber veil after they have been opened from the sliver, subsequently condensing the fiber veil transversely to its direction of motion to form an untwisted strand, transporting the strand through a nipping line, and twisting the strand to form a yarn downstream of the nipping line with the action of a rotating air stream, said arrangement including:

an opening roller for opening the at least one sliver to the single fibers, the collecting surface driven in the direction of motion of the single fibers for taking up the single fibers, a condenser effective transversely to the direction of motion of the single fibers for the condensing of the single fibers to form the untwisted strand, a nipping roller defining the nipping line for the nipping of the strand, and a twist nozzle for the twisting of the strand, wherein the collecting surface is arranged in direct proximity to the opening roller, wherein the condenser comprises at least one suction area diminishing in the direction of motion of the single fibers, and wherein a needle-like guidance is provided in the inside of the twist nozzle, aligned in the direction of motion of the strand, which guidance is disposed inside the strand and directed against an entry opening of a yarn withdrawal tube.

21. An arrangement according to claim 20, wherein the collecting surface is a perforated peripheral surface of a transport roller, whose circumferential speed is higher than the circumferential speed of the opening roller, the perforated surface being arranged at a suction area.

22. An arrangement according to claim 21, wherein arranged downstream of the transport roller is a drafting roller, which takes over the fiber veil from the transport roller, the periphery of said drafting roller being perforated and at which a suction area is arranged, the speed of the drafting roller being higher than the circumferential speed of the transport roller.

23. An arrangement according to claim 22, wherein the suction area of at least the drafting roller is designed tapering and ends in the area of the nipping roller.

24. An arrangement according to claim 23, wherein the opening roller and the collecting surface each have an effective width, which is designed for a number of single fibers per unit length which corresponds to the number of the fibers per unit length located in the cross section of the yarn.

25. An arrangement according to claim 23, wherein the opening roller and the collecting surface each have an effective width, which is designed for a number of single fibers per unit length which corresponds to the number of the fibers per unit length located in the cross section of the yarn.

26. An arrangement according to claim 23, wherein the opening roller is provided with a perforated peripheral surface connected to a suction device, as well as with a toothed ring, whose teeth have preferably a negative front angle.

27. An arrangement according to claim 23, wherein a withdrawal roller pair is arranged downstream of the yarn withdrawal tube, the speed of said withdrawal roller pair being somewhat higher than the circumferential speed of the nipping roller.

28. An arrangement according to claim 22, wherein the opening roller is provided with a perforated peripheral surface connected to a suction device, as well as with a toothed ring, whose teeth have preferably a negative front angle.

29. An arrangement according to claim 22, wherein a withdrawal roller pair is arranged downstream of the yarn withdrawal tube, the speed of said withdrawal roller pair being somewhat higher than the circumferential speed of the nipping roller.

30. An arrangement according to claim 20, wherein the opening roller and the collecting surface each have an effective width, which is designed for a number of single fibers per unit length which corresponds to the number of the fibers per unit length located in the cross section of the yarn.

31. An arrangement according to claim 30, wherein the opening roller is provided with a perforated peripheral surface connected to a suction device, as well as with a toothed ring, whose teeth have preferably a negative front angle.

32. An arrangement according to claim 30, wherein a withdrawal roller pair is arranged downstream of the yarn withdrawal tube, the speed of said withdrawal roller pair being somewhat higher than the circumferential speed of the nipping roller.

33. An arrangement according to claim 20, wherein the opening roller is provided with a perforated peripheral surface connected to a suction device, as well as with a toothed ring, whose teeth have preferably a negative front angle.

34. An arrangement according to claim 33, wherein a withdrawal roller pair is arranged downstream of the yarn withdrawal tube, the speed of said withdrawal roller pair being somewhat higher than the circumferential speed of the nipping roller.

35. An arrangement according to claim 20, wherein a withdrawal roller pair is arranged downstream of the yarn withdrawal tube, the speed of said withdrawal roller pair being somewhat higher than the circumferential speed of the nipping roller.

36. A spinning apparatus comprising:

an opening means for opening at least one sliver to single fibers, disposing means for disposing the single fibers on a moving collecting surface in the form of a fiber veil after they have been opened from the sliver, condensing means for subsequently condensing the fiber veil transversely to its direction of motion to form an untwisted strand, transporting means for transporting the strand through a nipping line, twisting means for twisting the strand to form a yarn downstream of the nipping line with the action of a rotating air stream, and means facilitating spreading out of fiber ends of the strand under the action of the rotating air stream.

37. A spinning process comprising:

opening at least one sliver to single fibers, disposing the single fibers on a moving collecting surface in the form of a fiber veil after they have been opened from the sliver, subsequently condensing the fiber veil transversely to its direction of motion to form an untwisted strand, transporting the strand through a nipping line, twisting the strand to form a yarn downstream of the nipping line with the action of a rotating air stream, and spreading out of fiber ends of the strand under the action of the rotating air stream during said twisting.

38. A spinning process according to claim 37, wherein the fiber veil is drafted in the direction of motion during condensing.

39. A spinning process according to claim 37, wherein the speed of the collecting surface corresponds approximately to the current speed of the single fibers when they reach the collecting surface.

40. A spinning process according to claim 37, wherein the fiber veil is condensed by means of pneumatic forces.

41. A spinning process according to claim 37, wherein the speed of the collecting surface corresponds approximately to the current speed of the single fibers when they reach the collecting surface.

42. A spinning process according to claim 41, wherein the fiber veil is condensed by means of pneumatic forces.

* * * * *